US005099805A

United States Patent [19]

Ingalls

[11] Patent Number: 5,099,805

[45] Date of Patent: Mar. 31, 1992

[54] VARIABLE VALVE ACTUATING DEVICE AND METHOD

[76] Inventor: William E. Ingalls, P.O. Box 393, Atascadero, Calif. 93423

[21] Appl. No.: 580,081

[22] Filed: Sep. 10, 1990

[51] Int. Cl.[5] ..... F01L 1/30; F01L 1/34; F01L 1/46

[52] U.S. Cl. ..... 123/90.15; 123/90.16; 123/90.17; 123/90.24; 123/90.6; 251/263; 251/254; 251/249.5; 74/56; 74/425; 74/568 R

[58] Field of Search ..... 123/90.15, 90.16, 90.17, 123/90.24, 90.6; 251/263, 254, 249.5; 74/568 R, 425, 56

[56] References Cited

U.S. PATENT DOCUMENTS

| | | | |
|---|---|---|---|
| 1,378,318 | 5/1921 | Brewer | 123/90.15 |
| 3,234,923 | 2/1966 | Fleck et al. | 123/90.15 |
| 3,424,139 | 1/1969 | Brooks | 123/90.1 |
| 4,256,065 | 3/1981 | Hirt | 123/90.11 |
| 4,777,915 | 10/1988 | Bonvallet | 123/90.15 |

OTHER PUBLICATIONS

"Continuous Camlobe Phasing", Jun. 1987, Automotive Engineering.

"Computer valvetrain may hike power, mpg", Nov. 20, 1989, Automotive News.

SAE Technical Papers Series No. 880386, "A Review of Variable Engine Valve Timing" by C. Gray, 5/1988.

SAE Technical Papers Series No. 880387 "The Synthesis and Analysis of Variable-Valve-Timing Mechanisms for Internal-Combustion Engines", F. Freudenstein.

SAE Technical Papers Series No. 880390 "Effect of Variable Engine Valve Timing on Fuel Economy" by T.H. Ma, May 1988.

SAE Technical Papers Series No. 880388 "Variable Valve Timing-A Possibility to Control Engine Load without Throttle" by Lenz, Wichart and Gruden, Jun. 1988.

"A survey of variable valve actuation", Jan. 1990, Automotive Engineering.

*Primary Examiner*—Willis R. Wolfe
*Assistant Examiner*—Thomas N. Moulis
*Attorney, Agent, or Firm*—Harold A. Burdick

[57] ABSTRACT

A variable valve actuating device and method are disclosed, the device including a rotatable cam having a selectively configured cam face engagable with a worm drive at an outer engaging surface of the cam, the worm drive being configured for both rotary and axial movement, rotary movement imparting rotational motion to the cam face, and axial movement changing relative valve timing. The device preferably includes a plurality of such rotatable cams engagable with different ones of a plurality of worm drives to thus provide selective variation of valve opening and valve closing times independently of one another, with open-valve duration being variable to occur at any point in an overall operating cycle of the system.

29 Claims, 6 Drawing Sheets

Fig_K

VARIABLE VALVE ACTUATING DEVICE AND METHOD

FIELD OF THE INVENTION

This invention relates to valve actuation, and, more particularly, relates to devices and methods for valve actuation which provide selective control of valve event timing and/or opening duration in the operating cycle of a system.

BACKGROUND OF THE INVENTION

A variety of valve actuating devices, primarily for internal combustion engines, have been heretofore suggested and/or utilized which include arrangements for variation of valve timing, of valve duration, and/or valve lift (see for example Nov. 20, 1989 Automotive News, "Computer Valve Train May Hike Power, MPG", "A Review Of Variable Valve Engine Timing" by C. Gray, in the SAE Technical Paper Series, No. 880386, "The Synthesis And Analysis Of Variable-Valve-Timing Mechanisms For Internal-Combustion Engines", by F. Freudenstein, in the SAE Technical Paper Series, No. 880387, and "A Survey Of Variable Valve Actuation", Automotive Engineering, January 1990). Such heretofore known devices have included hydraulic valve lifters (see U.S. Pat. Nos. 4,122,884 and 4,231,543), pneumatic valve lifters (see, for example, "Computer Valve Train May Hike Power, MPG", Automotive News, Nov. 20, 1989) and various mechanical approaches to valve event variability (see for example U.S. Pat. Nos. 4,577,598, 4,387,674, 4,388,897, 4,061,115, and "Continuous Cam Lobe Phasing", Society of Automotive Engineers, 1987).

The use of variable valve actuating devices has been recognized to provide numerous advantages including, for example, fuel economy advantages (see "Effect of Variable Engine Valve Timing On Fuel Economy", by T. H. Ma, SAE Technical Papers Series, No. 880390), and the opportunity for controlling engine load without a throttle plate (see "Variable Valve Timing—A Possibility To Control Engine Load Without Throttle", by Lenz, Wichart, and Gruden, SAE Technical Paper Series, No. 880388).

However, those devices which have been heretofore suggested and/or utilized have not always provided devices which are durable, which are conservative of engine power (see "Computer Valve Train May Hike Power, MPG" Automotive News, Nov. 20, 1989), are adaptable to either existing spring-loaded poppet valve systems or desmodromic systems, have the desired response to command time and cycle-to-cycle and cylinder-to-cylinder repeatability, lend themselves easily to computer control without continuous or high power supply requirements, and/or which are adjustable over a wide range in the normal operating cycle of the engine for controlling valve opening and, independently, valve closing at any selected time in an engine's operating cycle.

SUMMARY OF THE INVENTION

This invention provides a variable valve actuating device and method, the device including a rotatable cam having a face, a drive shaft engagable with the rotatable cam and configured for both rotary and axial movement, and a cam follower connected with the valve and contacting the face of the rotatable cam for activating the valve responsive to the configuration of the face of the rotatable cam. Preferably, first and second rotatable cams are provided with the faces of the cams being positioned adjacent to one another, and with first and second drives engagable with different ones of the first and second rotatable cams.

Rotational motion of the rotatable cam is imparted by the rotary movement of the drive shafts, the rotational movement being substantially angularly unidirectional. Variation of the position of the cam faces relative to one another (or, in the case of a desired valve timing adjustment or for use with only a single cam face, relative to the position of the cam follower at a selected time in the operating cycle of the system) is provided by axial movement of the drives.

In this manner, the position of either one or both of the selectively configured cam faces may be changed thus providing control over valve event timing and, independently, duration in the overall operating cycle of the system. The device is adaptable for use with spring-loaded poppet valve systems or for desmodromic valve actuation, and is configurable for use with controls for automatic response to sensed variations in system parameters such as operating speed and/or load.

The method provides selective control of valve event timing and duration in the operating cycle of the system by selectively opening the valve by rotating a first selectively configured cam face, closing the valve by rotating a second selectively configured cam face, and establishing an opening time for the valve in the overall operating cycle of the system and independently establishing a closing time for the valve in the overall operating cycle of the system by changing any of the position of the first cam face relative to the second cam face, the position of the second cam face relative to the first cam face, and the positions of both cam faces relative to a selected time in the operating cycle of the system.

It is therefore an object of this invention to provide an improved variable valve actuating device and method.

It is another object of this invention to provide an improved device and method for actuating valves which provide selective control of valve event timing and duration in an operating cycle of a system.

It is another object of this invention to provide a variable valve actuating device having a cam with an outer circumferential surface and a selectively configured cam face, the surface having engagable structure defined therearound, a cam follower connected with the valve, the cam follower for contacting the cam face, and a drive shaft engagable with the engagable structure of the outer surface of the cam and configured for both axial and rotary movement for imparting substantially unidirectional rotational movement to the cam face responsive to rotary movement of the drive shaft and for selective variation of the rate of rotation of the cam face responsive to axial movement of the drive shaft.

It is still another object of this invention to provide a valve actuating device for selectively controlling valve timing and duration in a operating cycle of a system that includes first and second rotatable cams each having selectively configured faces, the faces being positioned adjacent to one another, first and second drive shafts engagable with different ones of the first and second rotatable cams for independently imparting rotational motion to the rotatable cams, each of the drive shafts being adapted for both rotary and selective axial movement, and an activator connected with the valve and contacting the cam faces for opening and closing the valve at selected times responsive to rotation of the rotatable cams.

It is yet another object of this invention to provide a valve actuating device including a valve opening cam having a cam face, a valve closing cam having a cam face movably mounted adjacent to the valve opening cam so that the cam faces are maintained adjacent to one another, a cam follower contacting the faces of the cams, and a drive engagable with the cams for driving the opening and closing cams and for selective independent adjustment of the timing of valve opening and valve closing in an operating cycle of a system.

It is yet another object of this invention to provide an improved variable valve actuating device which may be adapted for use with existing spring-loaded poppet valve systems.

It is still another object of this invention to provide an improved variable valve actuating device which includes a plurality of rotatable cams and a plurality of drive shafts connected to different ones of the cams, each of the shafts configured for both axial and rotary movement, the cams being positioned relative to one another to provide desmodromic valve actuation.

It is yet another object of this invention to provide an improved valve actuating device and method for providing selective control of valve event timing and duration in an operating cycle of a system which includes controls for automatic response to variations in system operating speed, emissions and/or load during operation of the system.

It is still another object of this invention to provide a valve actuating method for selective control of valve timing and duration in an operating cycle of a system by selectively opening the valve by rotating a first selectively configured cam face, closing the valve by independently rotating a second selectively configured cam face, establishing an opening time for the valve in the operating cycle of the system and independently establishing a closing time for the valve in the operating cycle of the system and selectively reestablishing any one of or both the opening time and the closing time by changing a selected one of the position of the first cam face relative to the second cam face, the position of the second cam face relative to the first cam face, and the positions of both of the cam faces relative to a selected time in the operating cycle of the system.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
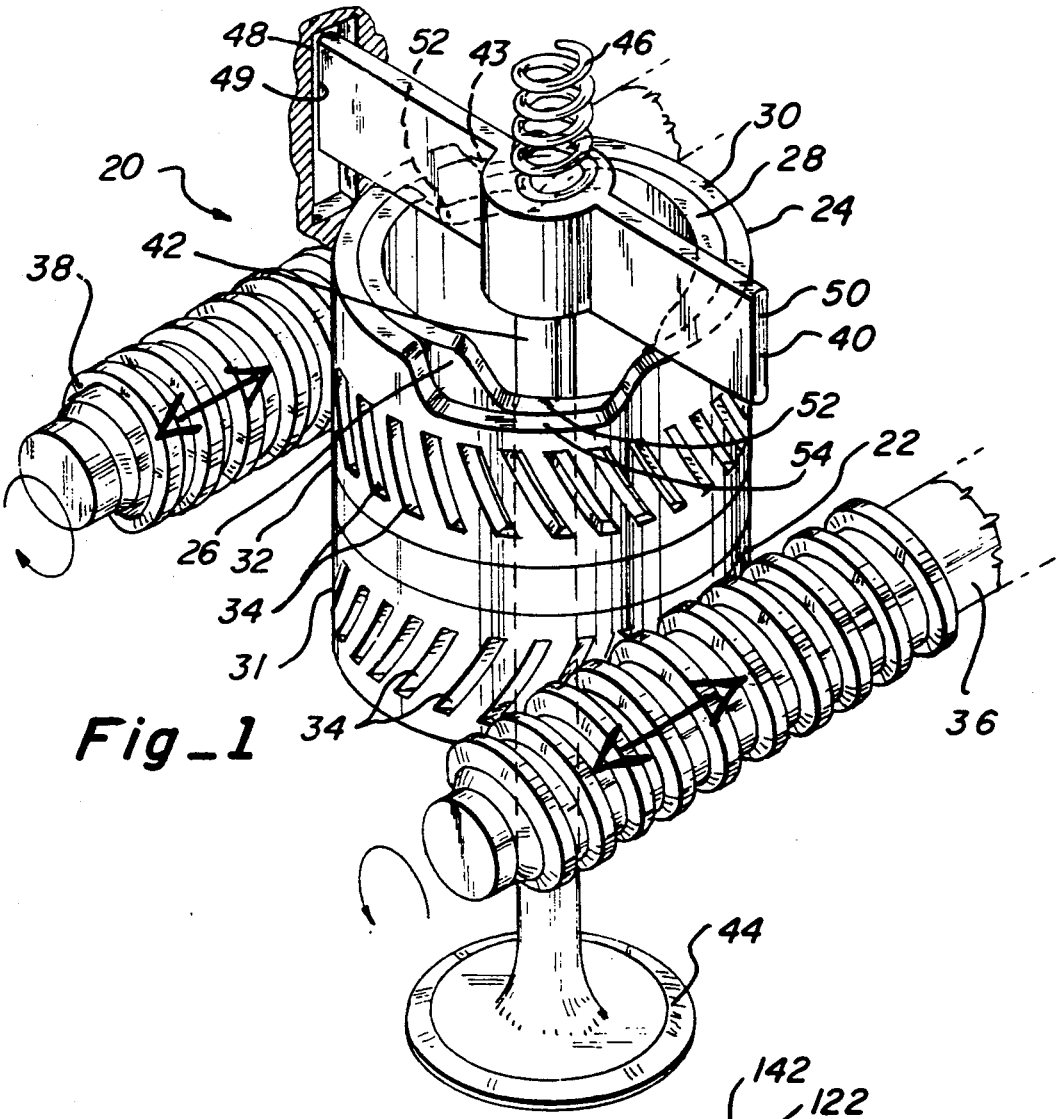
FIG. 1 is a basic operational illustration of the variable valve actuating device of this invention.

The basic operating principals of the variable valve actuating device of this invention are best illustrated by reference to FIGS. 1 and 2. Device 20 is shown in association with a spring for ease of illustration, it being understood that the spring represents any type of counteracting force producing mechanism whether active or passive (particular examples of which are set forth hereinafter). Actuating device 20 includes first and second rotatable cams 22 and 24, with cam 24 being mounted on annular neck 26 of cam 22. Each cam has a selectively configured cam face 28 and 30, respectively, at an upper part thereof, and engagable outer circumferential surfaces 31 and 32, respectively. The outer circumferential surfaces include worm drive engagable slots 34 machined into and around the surfaces thereof thus forming a worm gear around the surfaces for engagement with worm drive shafts 36 and 38 for rotation of cams 22 and 24. The slots in the cams and worm gear drives 36 and 38 are configured so that cams 22 and 24 rotate in the same direction when driven by rotary movement of worm drives 36 and 38. As more fully set forth hereinafter, worm drives 36 and 38 are commonly driven so that the cams rotate at substantially the same rate.

Cam follower 40, configured as a cross bar and preferably having a beveled lower edge, is connected with valve stem 42, for example by threading into threaded hub 43, and thus to valve 44 and is biased by spring 46 toward cam faces 28 and 30. Cam follower 40 is maintained in guides 48 (only one of which is seen in FIG. 1) at ends 49 and 50 thereof to thus limit rotation of cam follower 40. Guides 48 may be free standing, for example attached to the cam shaft housing, or can be ground into an existing head.

Cam faces 28 and 30 are rotated at equal speed and in the same direction by worm drives 36 and 38 (the direction of worm rotation being indicated by the arrows in FIG. 1), for example in a clockwise direction. As cam faces 28 and 30 rotate together, cam follower 40 holding valve 44 falls into and is lifted out of grooves 52 and 54 in cam faces 28 and 30, respectively, thus causing reciprocating motion of cam follower 40 and thereby opening and reseating of valve 44. The length of time that the valve is open, also called valve duration, is determined by the degree of overlap of grooves 52 and 54 of cam faces 28 and 30. The timing of a valve event (valve opening and then valve closing) in an operating cycle of a system, for example an engine, is determined by the position of the cam faces relative to a selected time in the operating cycle and thus the position of the cam faces relative to the cam follower at such time.

Figure 3:
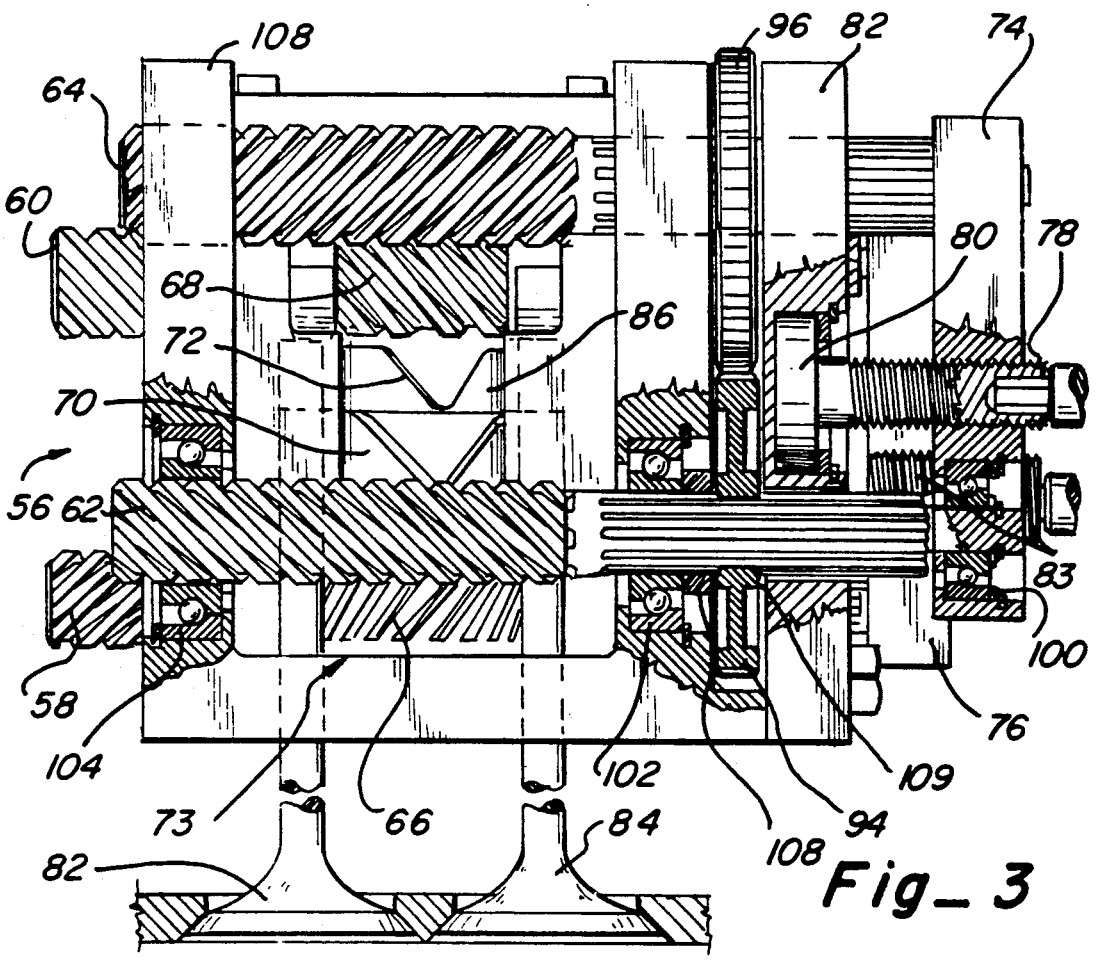
FIG. 3 is a side view of, with portions cut away to better illustrate, a first embodiment of a desmodromic variable valve actuating device of this invention.

Worm drives 36 and 38 are mounted (for example as illustrated in FIG. 3) to accommodate both rotary and axial movement (in the direction of the arrows in FIG. 1). When moved axially the drives act on worm gear slots 34 in the manner of a rack and pinion system causing the associated cam face to either advance or retard, depending on the direction of axial movement thus changing the overlap of grooves 52 and 54. This may be accomplished while the drives are at rest or while rotating at which time axial movement will alter the rate of rotation (either increasing or decreasing the rate depending upon the direction of axial movement) of the related cam relative to the worm drive.

In this way both valve opening time and valve closing time can be independently selected by moving the corresponding worm drive axially forward or backward to advance or retard the relative position of the related cam face. Since worm drives 36 and 38 are axially movable independent of one another, the position of cam face 28 can be changed relative to cam face 30, the position of cam face 30 can be changed relative to cam face 28, or the positions of both cam faces 28 and 30 can be substantially simultaneously changed. Thus valve duration can be altered while the engine is either operating or at rest and valve timing (that is the timing of valve opening and closing in an overall operating cycle of a system in which activating device 20 is located) can be altered by moving both worm drives in opposite directions to either advance or retard the valve opening/closing cycle. As may be appreciated, the open-valve duration can thereby be made to occur at any time in an overall operating cycle of the system (for example, in a typical 720° operating cycle of an engine, the selected open-valve duration can be set to occur at any point in the operating cycle).

Figure 2:
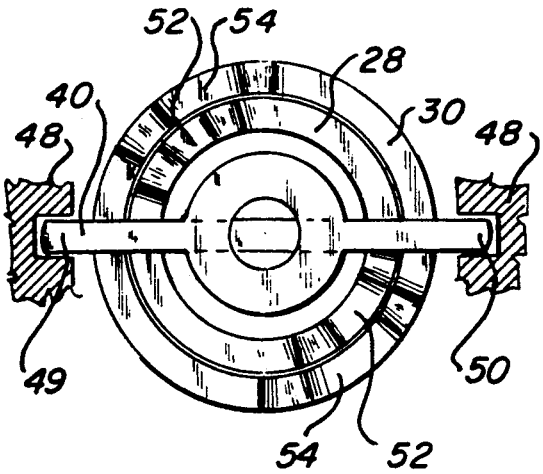
FIG. 2 is a top view of the device illustrated in FIG. 1.

It should be understood that, while both valve duration and timing are thus controlled by device 20 as shown in FIGS. 1 and 2, where only control over valve event timing is desired only one drive and one cam with the selectively configured cam face need be provided (thus resulting in a set duration but having wide ranging timing control).

Figure 11:
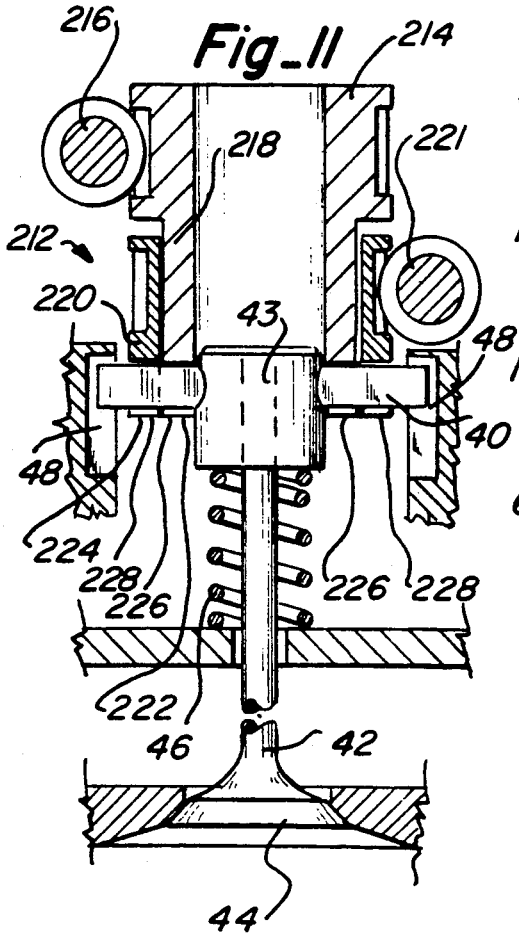
FIG. 11 is a sectional view of a third embodiment of the variable valve actuating device of this invention.

Turning now to FIGS. 3 through 8, a first embodiment of the invention is shown which is desmodromic in operation (that is, it provides both positive opening and closing of the valve rather than spring assisted opening or closing as illustrated in FIG. 1 and FIG. 11).

Device 56 includes a plurality of worm drives 58, 60, 62 and 64 engagable as heretofore set forth with a plurality of cams 66, 68, 70 and 72, respectively, in cam assembly 73. Worm drives 62 and 64 are commonly held in cross bar 74, and cams 58 and 60 are commonly held in cross bar 76 for joint movement upon movement of the cross bar. Cross bar 74 is threaded on threaded screw 78 which is journalled at end 80 in mounting 82 for rotational movement in the mounting. When the screw is turned (either clockwise or counter clockwise) cross bar 74 is moved laterally thus imparting axial movement the worm drives attached thereto. Axial movement of the worm drives in this fashion either advances or retards, depending upon the direction in which the screw is turned, related valve closing cam faces 70 and 72.

In like fashion, worm drives 58 and 60 are connected with cross bar 76 activated by screw 83 for axial movement thereof and control over related valve opening cams 66 and 68. For example rotating control screw 78 clockwise forces crossbar 74 to the right (in the FIG. 3) thus pulling worm drives 62 and 64 which, in this embodiment, causes dual intake valves 82 and 84 to close earlier (thus shortening valve duration) as cam follower 86 reciprocates responsive to rotation of the valve faces. Valve opening is not effected. Counter-clockwise rotation of screw 78 forces cross bar and drives 62 and 60 to the left in FIG. 3 and causes the valves to close later (thus lengthening valve opening duration) without effecting valve opening time.

When screw 83 is turned in a clockwise direction, cross bar 76, and thus attached worm drives 58 and 60 are pulled to the right in FIG. 3 which, in this embodiment, causes the dual intake valves to open later (thus shortening valve duration) without effecting when the dual intake valves are closed. Counter-clock rotation of screw 83 forces cross bar 76 to the left in FIG. 3 and causes the dual valves to open earlier (thus lengthening valve duration) without effecting valve closing time.

To change valve timing without changing valve duration, substantially simultaneous and equal, but counter, rotation of screws 78 and 83 is performed. In this embodiment equal rotation of valve closing screw 78 (in a clockwise direction) and valve opening screw 83 (in a counter-clockwise direction) retard overall valve timing. Of course valve duration remains unchanged. Equal rotation of valve closing screw 78 in a counter-clockwise direction and valve opening screw 83 in a clockwise direction advances the overall valve timing.

Figure 7:
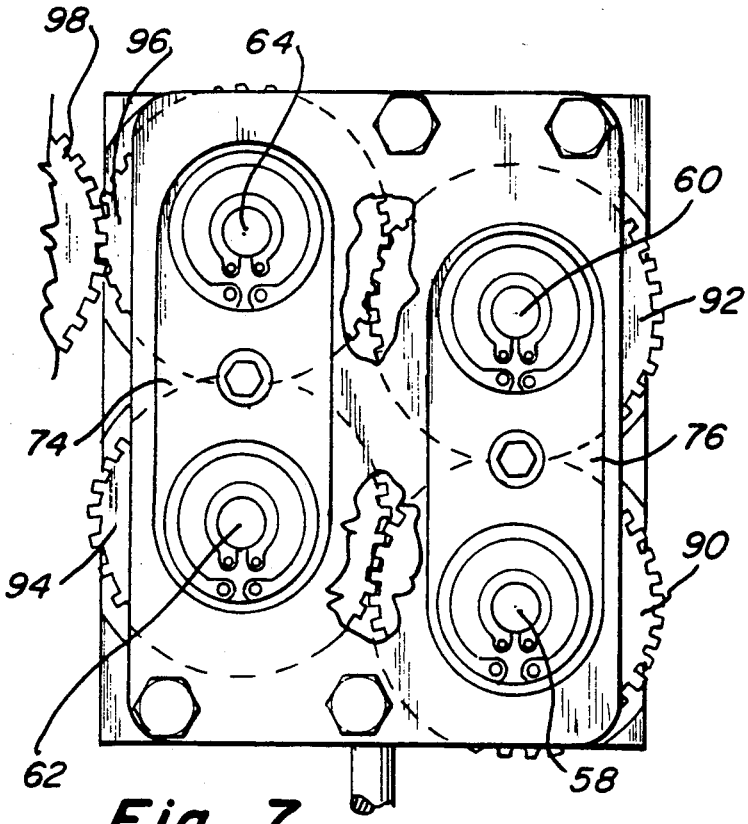
FIG. 7 is an end view, with some portions cut away, further illustrating the drive and control arrangement of the device shown in FIG. 3.

Worm drives 58, 60, 62 and 64 are male splined at one end (shown in FIG. 3 for drives 62 and 64 drives 58 and 60 being similarly splined) to fit through the center of female splined drive gears 90, 92 or 94 and 96, respectively. In this manner, the worm drives are capable of sliding axially back and forth through the gears, allowing a lateral repositioning of the worm drives without loss or interruption of rotational power transmission from the gears (the gears being meshed and driven by drive gear 98 as shown in FIG. 7). Bearings of any known variety (herein shown as ball bearings 100, 102 and 104) are provided to allow thrust loading (bearing 100), rotational loading (100, 102 and 104) and lateral sliding (102 and 104) of the worm drives (it being understood that all worm drives are provided with a similar bearing arrangement). Bearing 104 is mounted in end bar 106.

As shown in FIG. 7, drive gears 90, 92, 94 and 96 are meshed so that rotation of one gear causes equal rotation of all gears. Power from the engine crank shaft is linked to the gears (for example via a timing chain, gear train or cogged belt system). Power can also be transmitted to the drive gears by extending the opposite end of any one of the worm drives so that rotation is transmitted down such a master-driven worm drive to the four gear complex, and then redistributed equally to all four worm drives. Drive gears 90, 92, 94 and 96 are held in place laterally, for example by spacers 108 and 109 (it being understood that similar such spacers are provided for each drive gear) so that the drive gears are free to rotate but remain in proper alignment with each other when the worm drives are moved laterally to the right or left.

Turning now to FIGS. 5 and 6A through 6D, cam assembly 73 includes centering rod 110 provided as a common center of rotation for the cams and to keep the cams aligned with each other during operation. Centering rod 110 is free to rotate with rotation of cams 66, 68, 70 and 72. Angular contact bearings 112 and 114 absorb vertical loads transmitted from the contact between the cam faces and cam follower 86 and allow low friction rotation of the entire assembly during operation. These bearings could be replaced with low pressure hydraulic pistons utilizing the engines lubricating oil pressure system to thus gently squeeze the rotating cam faces together and against the cam follower with the object of automatically removing all slack from the assembly and noise associated with its operation. This would also eliminate the need for cam positioning spacers, seating tensioners and the like.

Figure 8:
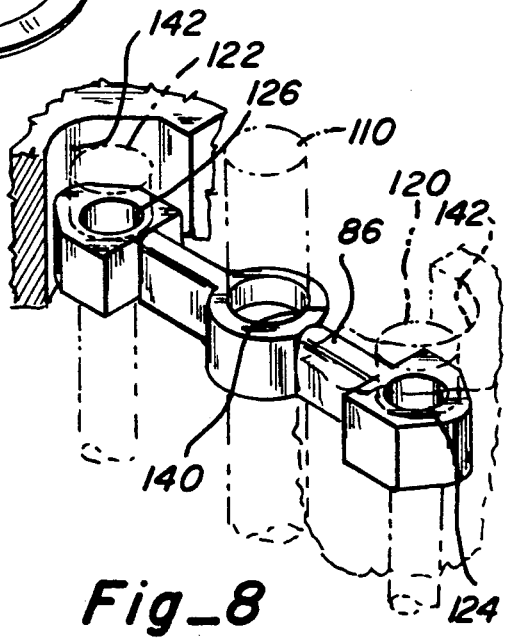
FIG. 8 is a detailed perspective view of the cam follower and guides utilized in the device shown in FIG. 3;, FIGS. 9A, 9A*a*, 9A', 9A*a'*, 9B, 9B*b*, 9B', 9B*b'* and 9C–9K are illustrations showing the range of relative positioning of the rotatable cams and the various valve event adjustments achievable utilizing the device.

Cam assembly positioning spacers 116 and 118 are utilized to provide the appropriate clearance between cam follower 86 and the cam faces. Bolts 120 and 122 are received through openings 124 and 126, respectively (as shown in FIG. 8) and are screwed into valve stems 128 and 130 connected with valves 84 and 82, respectively. Snap rings, collars, collets, or the like, could as well be utilized.

Valve tensioner cup/spacers 132 and 134, having an appropriate thickness, are provided to adjust the tension needed to seat the valve without creating too much or too little pressure on the valve, the cam follower, or the cam faces. Small coil springs, Belleville springs, or other compliance means such as polyurethane valve seating tensioners, 136 and 138 are provided, and act as springs to absorb dimensional changes that may occur as the valve and all other mechanical components expand and contract during operation. In this manner, the valve is always fully seated when closed without overstressing the components of the variable valve actuating device and/or the valve itself. Cam follower 86 is contained between the rotating cam faces of cams 66, 68, 70 and 72. It is held in place laterally by centering rod 110 through center opening 140 (as shown in FIG. 8) with the center opening being of a size to allow centering rod 110 to freely rotate. Centering rod opening 140 is tapered to allow for a maximum of 5° tilt of cam follower 86 in any direction without binding or restricting the centering rods rotation or the vertical movement of the cam follower. Cam follower 86 is kept from rotating with the cam faces by vertical guide slots 142 (either free mounted or machine into a head or the like).

Valve opening spacers 144 and 146 are made of a selected thickness in order to adjust valve opening (or lift) without incurring too tight or too loose a fit with reference to the cam follower.

Figure 5:
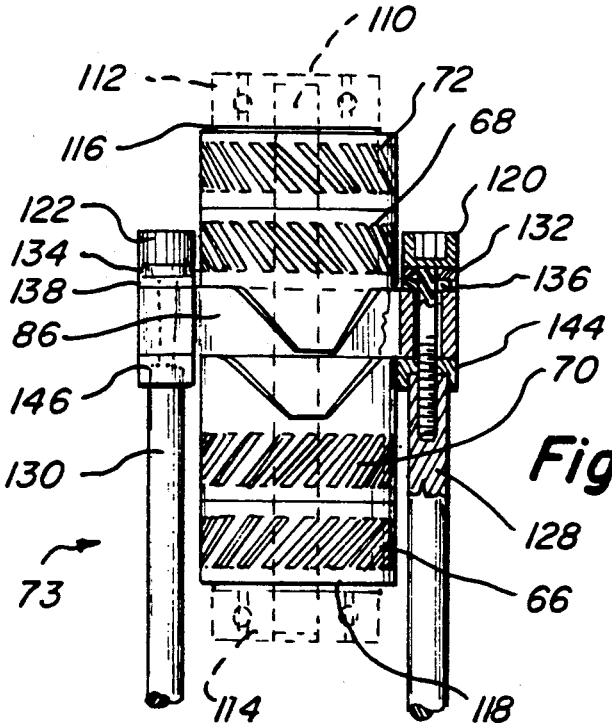
FIG. 5 is a side view, with cut away sections, of the rotatable cam arrangement utilized in the device shown in FIG. 3.
Figure 6C:
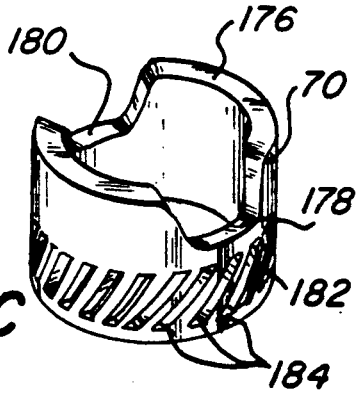
Figure 6D:
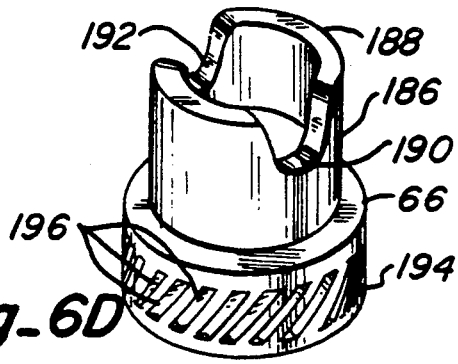

The entire assembly shown in FIG. 5 is designed to allow valves 82 and 84 to rotate during operation in order to minimize the possibility of burning a valve due to particle build-up on the valve and/or valve seat surfaces. A rotating valve wipes itself clean as it operates. Valve spacers 144 and 146 act as contact bearing surfaces for cam follower 86 during the opening phase and also adjusts for valve height differences due to valve manufacturing variations and/or valve seat grinding depth variations.

Turning now to FIGS. 6A through 6D, the rotatable cams are shown, it being understood that the cam pairs (for example cams 66 and 72 or cams 68 and 70) shown could as well be utilized in the other embodiments of the invention described herein, although it may be desirable to expand the cross-sectional thickness of the non-load bearing cam of the pair (cam 66 or 72). Valve closing receiver cam 72 includes center mounting opening 150 for centering rod 110 (not shown in FIG. 6A through 6D, a corresponding center mount opening being provided in cam 66) and includes outer circumferential surface 152 having worm gear teeth engagable slots 154 thereat and neck 156 for mounting thereover of cam 68. Selectively configured cam face 158 includes ca lobes 160 and 162 at opposite sides of the cam face. This cam face does not bear the load of opening or closing the valve. Its purpose is to fill the void created when varying the valve duration and keep cam follower 86 from drifting up or down out of alignment with the desired path of travel.

Valve opening cam 68 includes opening 164 mountable over neck 156 of cam 72 and cam face 166 including cam lobes 168 and 170. Outer circumferential surface 172 includes worm gear teeth engagable slots 174. This cam face operates directly against cam follower 86 and forces cam follower 86 downward to open the valves. It is of a thicker cross-section than receiver cam 72 in order to absorb the valve acceleration loading generated during the opening phase. Cam 68 is maintained in position by neck 156 of cam 72 and is free to rotate in relation to cam 72.

Valve closing cam 70 includes cam face 176 having grooves 178 and 180 thereat, and outer circumferential surface 182 having worm gear teeth engagable slots 184 therein. Cam 70 operates directly against cam follower 86 and forces it upward to close the valve. It also is of a thicker cross section than receiver cam 66 in order to absorb valve acceleration loading generated during the closing phase. Cam 70 is held in place on neck 186 of cam 66 and is free to rotate in relation to cam 66.

Valve opening receiver cam 66 includes neck 186, cam face 188 having grooves 190 and 192 thereat, and outer circumferential surface 194 having worm gear teeth engagable slots 196 therearound. This cam, like cam 72, does not take the load of opening or closing the valve. Again, it is to fill the void created when varying the valve duration and keep cam follower 86 from drifting up or down out of alignment with the desired path of travel. Cam 66 is held in place on centering rod 110 and also acts as a carrier and bearing surface for cam 70.

Figure 9A:
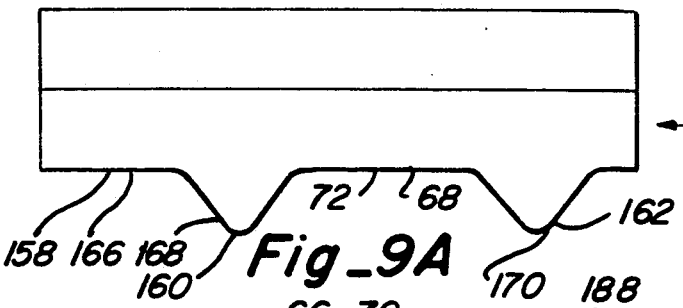
Figure 9A:
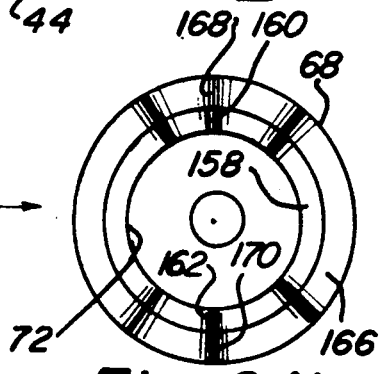
Figure 9A:
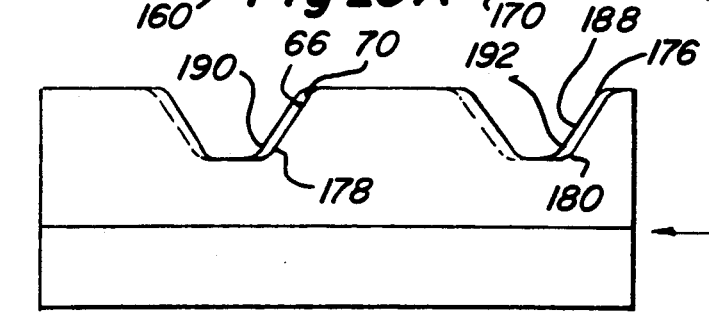
Figure 9A:
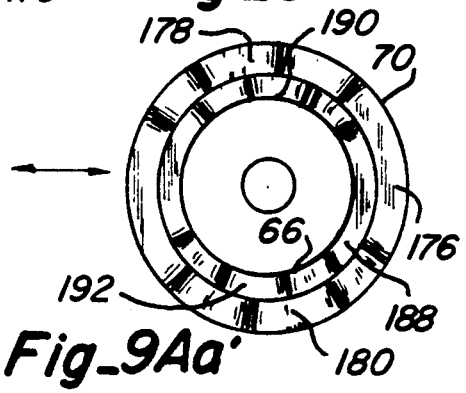
Figure 9B:
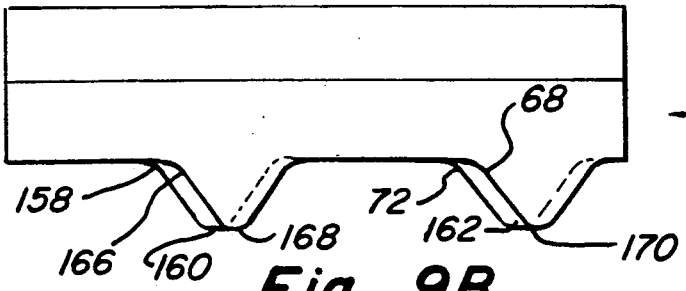
Figure 9B:
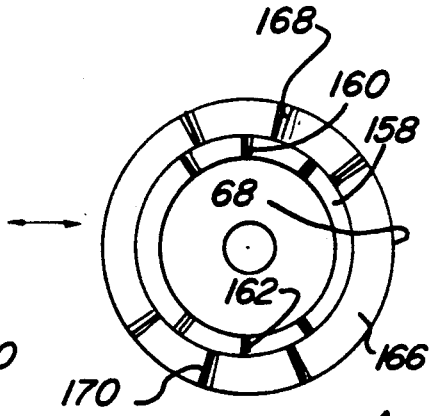
Figure 9B:
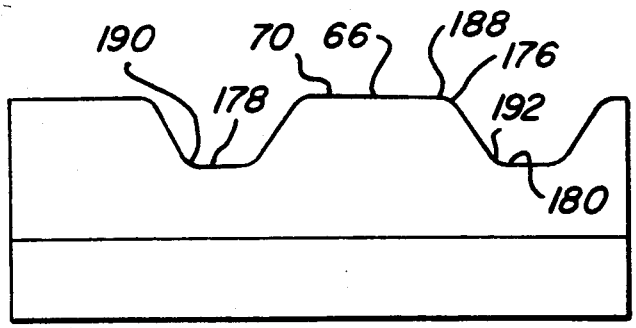
Figure 9B:
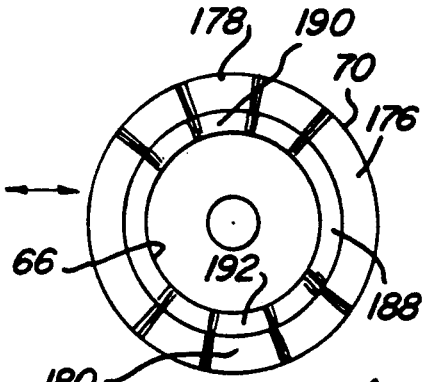

By way of example, and as illustrated in FIGS. 9A and 9B wherein the cam faces are linearly illustrated, when used in an engine having 4 to 1 crank to cam face rotation ratio, grooves 178 and 180 and grooves 190 and 192 of the cam faces of cams 70 and 66, respectively, may each encompass approximately 72.5° in 180° of the circumference of the cam face. Cam lobes 160 and 162 and lobes 168 and 170 of the faces of cams 72 and 68, respectively, may each encompass approximately 55.5° in 180° of the circumference of the cam face. Thus, as illustrated in FIG. 9A, with the lower cam faces shifted and the upper cam faces aligned, a short duration (approximately 222° in the 720° operating cycle of the engine) of valve opening is provided as may be required, for example, for low speed operation of the engine. As illustrated in FIG. 9B, with the upper cam faces shifted and the lower cam faces aligned a relatively long opening duration is provided (approximately 290° in the 720° operating cycle of the engine) appropriate, for example, for high speed operation. This embodiment would thus provide variability of valve duration anywhere in a 68° range from a minimum of 222° to a maximum of 290°, approximately, of a 720° operating cycle.

Figure 9C:
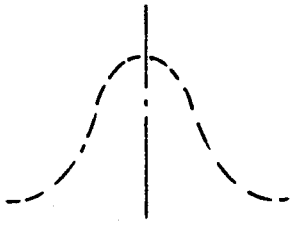
Figure 9H:
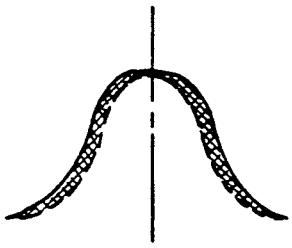
Figure 9D:
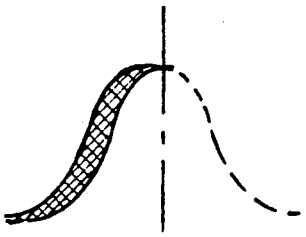
Figure 9I:
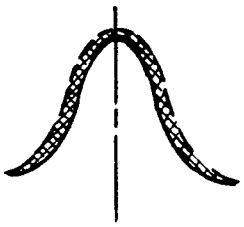
Figure 9E:
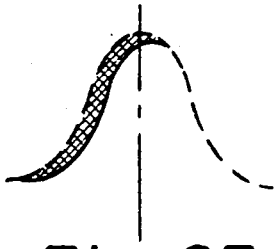
Figure 9J:
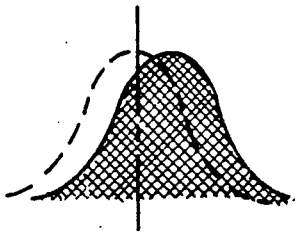
Figure 9F:
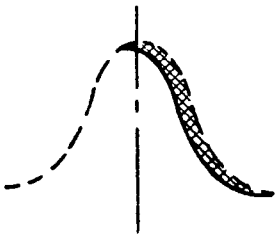
Figure 9G:
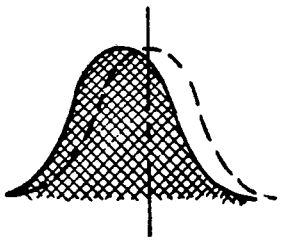
Figure 9G:
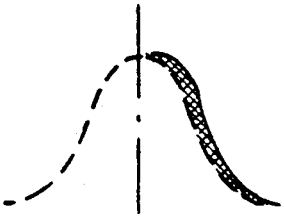

FIG. 9C through 9K illustrate the various change in timing and/or duration thus achievable. FIG. 9C is exemplary of the standard known duration and timing of a valve utilized with internal combustion engines (by way of example representing approximately a 250° opening duration in a 720° engine operating cycle and centered around top dead center). Utilizing the device of this invention early valve opening (up to 40° over the 250° duration for example) without changing closing time (FIG. 9D), late opening (down to 222° duration for example) without closing time change (FIG. 9E), early valve closing (down to 222° duration for example) without changing opening time (FIG. 9F), late valve closing (up to 40° over the 250° duration for example) without changing opening time (FIG. 9G), combination thereof (FIGS. 9H and I), and shifting (either early or late timing) of the selected duration (FIGS. 9J and 9K) can be accomplished.

Figure 4:
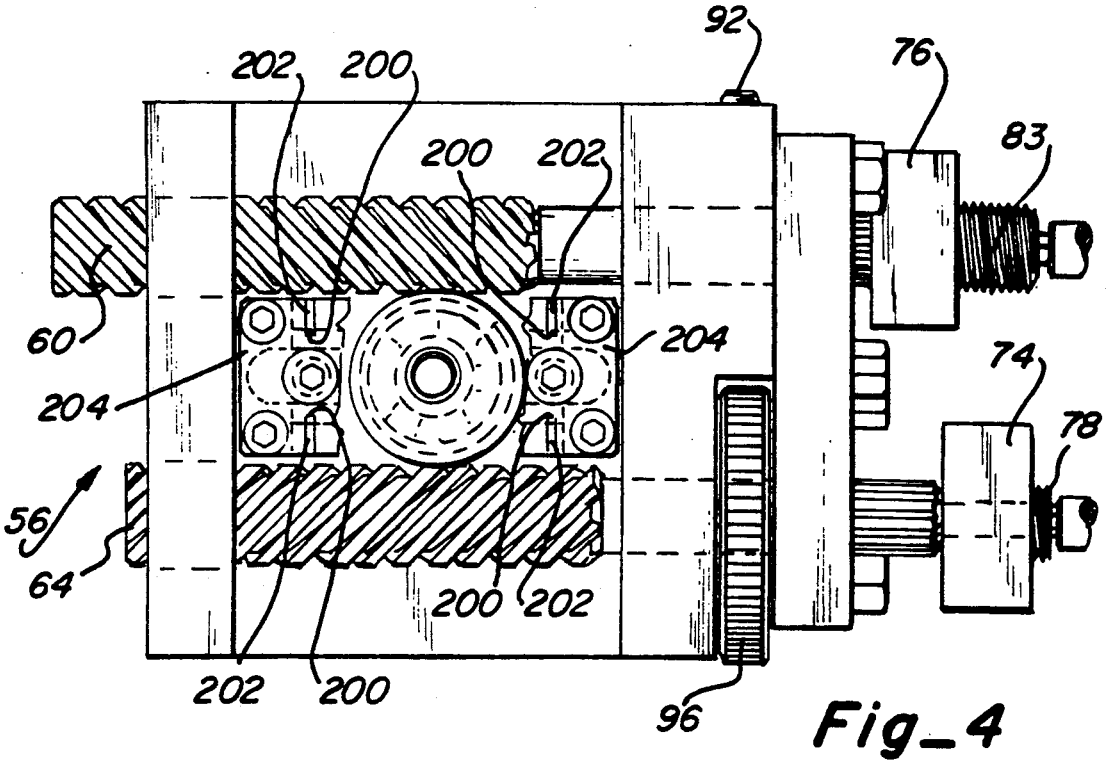
FIG. 4 is a top view of the device illustrated in FIG 3.

Vertical guides 142 may include (as shown in FIG. 4) steel inserts 200 held in place adjustably by set screws 202 to allow vertical movement of the cam follower with a minimum of rotational movement and/or noise. A center rod bearing end plate 204 may be held in place, for example, by bolts, to hold angular contact bearing 112 (as shown in FIG. 5).

It should be appreciated from the description of the embodiment of the invention shown in FIGS. 3 through 8 that, where only control over valve timing (and not duration) is desired, only cams 68 and 70 driven by a single associated drive means need to be provided thus providing desmodromic valve actuation with widely variable timing capability.

Figure 10:
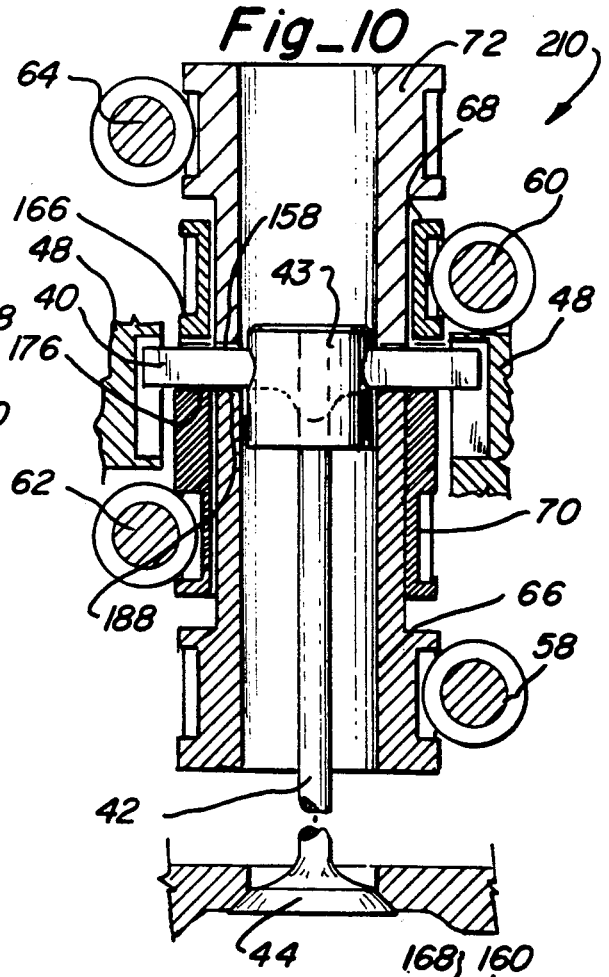
FIG. 10 is a sectional view of a second embodiment of the variable valve actuating device of this invention.

Turning now to FIG. 10, alternate embodiment 210 is shown, similar in many regards to the embodiment of the invention illustrated in FIGS. 3 through 8, but providing single valve actuation with the valve being attached to cam follower 40 at the center thereof (as also shown in FIG. 1).

Figure 6A:
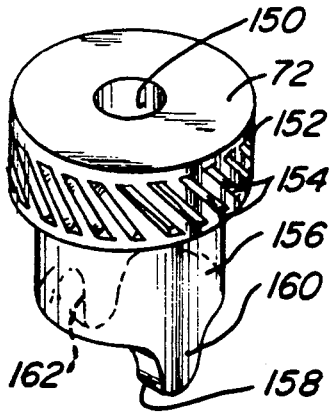
FIGS. 6A, 6B, 6C, and 6D are perspective views of the rotatable cams illustrated in FIG. 5.
Figure 6B:
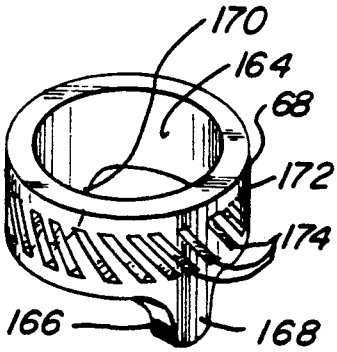

FIG. 11 shows an additional embodiment utilizing a center valve mounting as shown in FIG. 10, but utilized with a standard spring-loaded poppet valve-type system and additionally utilizing cam faces configured similarly to those shown in FIGS. 6A and 6B to provide variable valve event timing and duration. Device 212 includes rotatable cam 214 activated as heretofore set forth by worm drive 216. Cam 214 includes shoulder 218 having rotatable cam 220 movably mounted thereon for active engagement with drive 221. Cam faces 222 and 224 are configured similarly to cam faces 158 and 166, respectively, of cams 72 and 68 (see FIGS. 6A and 6B) including lobe pairs 226 and 228 the sweep of which along their related cam face determine, jointly, the open-valve duration.

The embodiment of the invention shown in FIGS. 1, 10 and 11 may be operationally mounted utilizing bearing and race mounts or the like known to those skilled in the art (for example, a valve mounting arrangement similar to that shown in FIG. 5 and adapted for mounting at hub 43, but utilizing a flanged bearing or the like to position cam 214 and thus cam 220).

Figure 12:
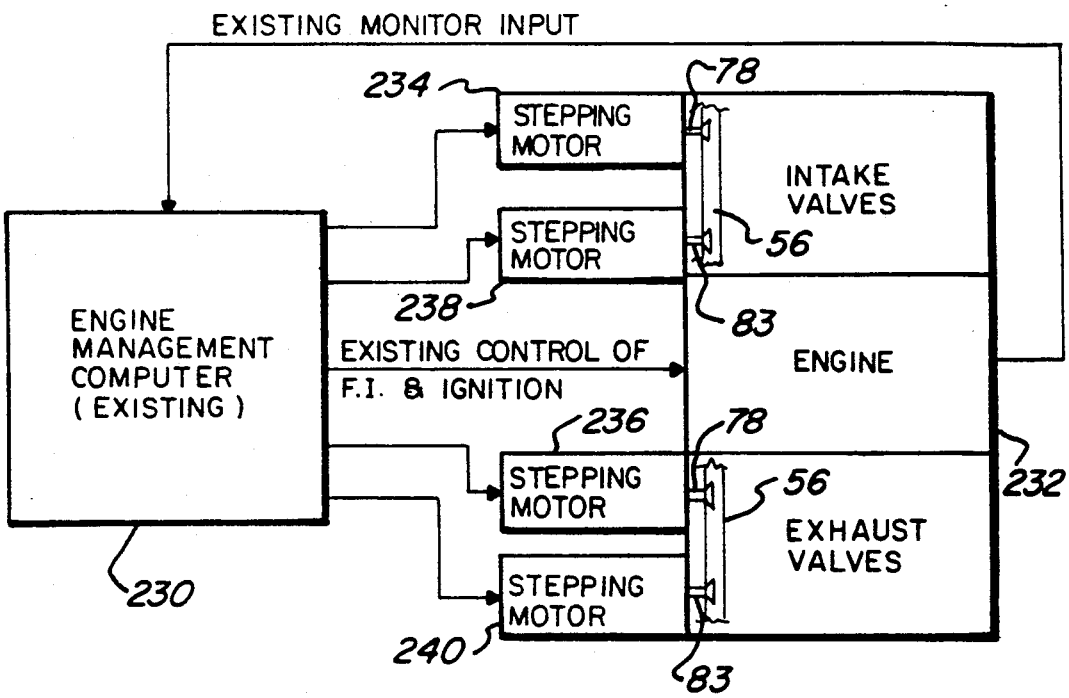
FIG. 12 is a block diagram illustrating control of the variable valve actuating device of this invention utilizing an existing engine management computer.

FIG. 12 illustrates a control system utilized in conjunction with the valve actuating device of this invention and specifically configured for the embodiment thereof illustrated in FIGS. 3 through 8. The existing engine management computer 230, now provided in many, if not most, internal combustion engine powered vehicles, typically monitors RPM, hydrocarbon and nitrogen oxide emissions, engine temperature, fuel type and consumption, intake air flow rate, exhaust temperature and throttle position of engine 232. Computer 230 also now typically controls electronic fuel injection and ignition timing.

With the addition of step motors 234 and 238 connected to screws 78 and 83 of desmodromic device 56 (as shown in FIG. 4) controlling the duration and timing of the intake valves, and step motors 236 and 240 connected to an identical sound desmodromic device 56 controlling the duration and timing of the exhaust valves, it becomes possible to independently control the duration and timing of both the intake and exhaust valves with computer 230 responsive to monitored changes in RPM, load and/or emissions output, producing new selected step motor positions utilizing either a feedback loop or preprogrammed step motor position settings. The selected step motor repositioning in turn rotates the related adjustment screw (78 and/or 83) thus providing valve event timing and/or duration control, as heretofore set forth, independently for exhaust and intake valves.

As may be appreciated from the foregoing, this invention provides an improved variable valve actuating device and method which provides control of valve opening time and, independently, valve closing time in an operating cycle of a system such as an internal combustion engine. The design is adaptable for existing spring-loaded poppet valve systems and for desmodromic operation. In desmodromic form, operating speeds from very low idle speeds up to approximately 17,000 RPM are accommodated.

The device is totally mechanical, and is designed specifically to keep the reciprocating mass at a minimum while providing rugged dependability (the device being constructed of known machinable or castable materials such as heat treatable or case hardenable metals, titanium, magnesium, thermoplastics, impact resistant ceramics, high strength bronze and/or aluminum alloys and the like) and excellent response-to-command time and cycle-to-cycle and cylinder-to-cylinder repeatability. The system also lends itself to computer control without continuous or high power supply requirements, bulky and/or expensive equipment, complex electrical circuitry or component temperature sensitivity.

Because the device features continuously flexible valve event timing and duration over such a wide range of operating conditions it may be possible to eliminate the need for a traditional throttle plate (and the pumping losses associated with such throttles) and can optimize performance, economy and emissions across a wide range of engine speeds. It should also be possible to produce variable compression ratios which, in the case of diesel engines, could be used to make starting easier at a high compression ratio while allowing more efficient fuel consumption at speed by continuously optimizing the "breathing" requirements at all possible driving and load conditions.

While a 68° valve-open duration range (between 222° and 290° with reference to the angle of rotation of the crank shaft) has been described herein, the primary limiting feature thereof is the diameter of the cams. The valve duration range herein described is achieved utilizing approximately a 1.1 inch diameter cam face overall, and such range can be significantly increased by enlarging the diameter of the cams.

What is claimed is:

1. A variable valve actuating device comprising:

a cam having an outer circumferential surface and a selectively configured cam face, said surface having engagable structure defined therearound;

cam follower means connected with the valve, said cam follower means for contacting said cam face; and drive means engagable with said engagable structure of said surface of said cam and configured for both axial and rotary movement, said drive means for imparting substantially unidirectional rotational movement to said cam face responsive to rotary movement of said drive means and for selective variation of rate of rotation of said cam face relative to rate of rotary movement of said drive means responsive to axial movement of said drive means, whereby rotational movement of said cam face imparts reciprocal movement to said cam follower means and whereby selective axial movement of said drive means changes the relative time at which reciprocation of said cam follower means occurs.

2. The device of claim 1 wherein said cam face is substantially circular and includes one of grooved sections and lobes corresponding to a desired duration during which the valve is open.

3. The device of claim 1 including biasing means for biasing said cam follower means toward contact with said cam face.

4. The device of claim 1 wherein said drive means is a worm drive shaft and wherein said engagable structure is configured as a worm gear.

5. The device of claim 1 further comprising a second cam having an outer circumferential surface and a selectively configured cam face, said surface having engagable structure defined therearound for engaging said drive means, said cam faces being positioned adjacent to one another at different sides of said cam follower means to provide desmodromic valve actuation.

6. The device of claim 1 wherein said drive means includes a wormed surface and a splined surface, said wormed surface for engaging said engagable structure of said cam and said splined surface slidably engaged through a drive gear for imparting said rotary movement to said drive means while accommodating axial movement of said drive means therethrough.

7. A valve actuating device providing selective control of valve timing and duration in an operating cycle of a system, said valve actuating device comprising:

a valve opening cam having a cam face;

a valve closing cam having a cam face and movably mounted adjacent to said valve opening cam so that said cam faces are maintained adjacent to one another;

drive means engagable with said cams for driving said opening and closing cams and for selective independent adjustment of the timing of valve opening and of valve closing in the operating cycle of the system; and cam follower means connected with said valve and contacting said cam faces for opening and closing the valve responsive to the relative position of said cam faces.

8. The device of claim 7 wherein said cam faces are positioned at different sides of said cam follower means to provide desmodromic valve actuation.

9. The device of claim 7 wherein said cams have a substantially circular cross section and wherein said cam faces are circumferentially described at one end thereof.

10. The device of claim 9 wherein each of said cam faces have grooved portions, alignment of said grooved portions by said drive means corresponding to maximum valve duration, shifting of relative positioning of said grooved portions from alignment by said drive means causing shortening of valve duration, a substantially simultaneous shifting of said grooved portions by said drive means causing a selected change in valve event timing.

11. The device of claim 10 wherein said grooved portions occupy about 72.5° in 180° of said cam faces thereby providing a selectable range of valve duration of between about 222° and 290° in a 720° operating cycle of a system.

12. The device of claim 9 wherein each of said cam faces have lobes, alignment of said lobes by said drive means corresponding to minimum valve duration, shifting of relative position of said lobes from alignment by said drive means causing lengthening of valve duration, a substantially simultaneous shifting of said lobes by said drive means causing a selected change in valve event timing.

13. The device of claim 7 wherein one of said valve opening cam and said valve closing cam has an annular neck and wherein the other of said cams is rotatably mountable on said neck.

14. The device of claim 13 further comprising third and fourth cams engagable with said drive means and having substantially circular cross sections and selectively configured cam faces, said third cam having an annular neck for rotatably mounting said fourth cam thereon so that said cam faces of said third and fourth cams are maintained adjacent to one another and at a different side of said cam follower means from said cam faces of said first and second cams.

15. The device of claim 7 wherein said drive means includes first and second worm drive shafts each having a wormed surface and a splined surface at opposite ends of said shafts, said wormed surfaces engaging different ones of said cams, said drive means including first and second drive gears each slidably receiving a different one of said splined surfaces of said shafts through a central part thereof, said drive gears being meshed at an outer part thereof.

16. The device of claim 7 wherein said drive means is configured for both rotary and axial movement, said rotary movement driving said cams and said axial movement adjusting said timing of valve opening and of valve closing, the device further comprising control means connected with said drive means for controlling said axial movement.

17. A valve actuating device providing selective control of valve event timing and duration in an operating cycle of a system, said valve actuating device comprising:

first and second rotatable means each having a selectively configured face, said faces being positioned adjacent to one another;

first and second drive means engagable with different ones of said first and second rotatable means for imparting rotational motion to said rotatable means, said drive means being adapted for rotary movement and each of said drive mean being adapted for selective axial movement independently of one another, said rotary movement imparting substantially unidirectional rotational motion to said rotatable means and said selective axial movement for varying at least one of valve event timing and duration in the operating cycle of the system.

activating means connected with the valve and contacting said faces for opening and closing the valve at independently selected times in the operating cycle of the system responsive to substantially unidirectional rotation of said first and second rotatable means.

18. The device of claim 17 further comprising third and fourth rotatable means each having a selectively configured face positioned adjacent to one another, and third and fourth drive means engagable with different ones of said third and fourth rotatable means for imparting rotational motion thereto and being adapted for movement substantially similar to said first and second drive means, said faces of said third and fourth rotatable means being positioned adjacent to said activating means at a different side thereof from said faces of said first and second rotatable means.

19. The device of claim 18 wherein said rotatable means each have a substantially circular cross section with said faces of said first and second rotatable means having grooved sections and with said faces of said third and fourth rotatable means having lobes, valve duration corresponding to selected relative positions of said grooves with respect to one another and of said lobes with respect to one another responsive to axial movement of said drive means.

20. The device of claim 19 wherein said first and third drive means are connected with one another for common axial movement and wherein said second and fourth drive means are connected with one another for common axial movement.

21. The device of claim 20 wherein said rotatable means each include an outer circumferential surface configured as a worm gear, and wherein said drive means each include a wormed surface at one end engagable with said surface of a related said rotatable means and a splined surface at an opposite end thereof.

22. The device of claim 17 further comprising control means connected with said drive means for controlling said axial movement.

23. The device of claim 17 wherein said activating means includes a follower configured for connection at opposite ends thereof with first and second valves, said activating means including guide means for restricting rotation of said follower while accommodating reciprocating movement thereof.

24. A valve actuating method providing selective control of valve timing and duration in an operating cycle of a system, said valve actuating method comprising:

opening the valve by rotating a first selectively configured cam face;

closing the valve by rotating a second selectively configured cam face;

selectively establishing an opening time for the valve in the operating cycle of the system and independently selectively establishing a closing time for the valve in the operating cycle of the system; and selectively reestablishing any one of said opening time in the operating cycle, said closing time in the operating cycle, and both said opening time and said closing in the operating cycle by changing a selected one of the position of said first cam face relative to said second cam face, the position of said second cam face relative to said first cam face, and the positions of both of said cam faces relative to a selected time in the operating cycle of the system.

25. The method of claim 24 wherein the step of selectively reestablishing any one of opening, closing and both opening and closing times is accomplished during operation of the system.

26. The method of claim 24 further comprising establishing and reestablishing said times responsive to selected operating conditions of the system.

27. The method of claim 24 further comprising rotating said cam faces by rotating first and second worm drives engagable with different ones of first and second cams having different ones of said cam faces thereat.

28. The method of claim 27 further comprising selectively axially moving said worm drives to change a selected one of the position of said first cam face relative to said second cam face, the position of said second cam face relative to said first cam face, and the positions of both cam faces relative to said selected time.

29. The method of claim 24 wherein valve duration is adjustable in a 68° range between 222° and 290° of a 720° operating cycle of said system.

* * * * *